United States Patent [19]

Yamamoto et al.

[11] Patent Number: 4,808,486

[45] Date of Patent: Feb. 28, 1989

[54] PRODUCTION METHOD OF MACHINE PARTS AND THE MACHINE PARTS THUS PRODUCED

[75] Inventors: Harutoshi Yamamoto; Zenichi Mochizuki; Sadasue Sakomoto, all of Numazu, Japan

[73] Assignee: Toshiba Kikai Kabushiki Kaisha, Tokyo, Japan

[21] Appl. No.: 70,059

[22] Filed: Jul. 6, 1987

Related U.S. Application Data

[62] Division of Ser. No. 759,101, Jul. 25, 1985, Pat. No. 4,693,293.

[51] Int. Cl.[4] ..... B32B 15/01

[52] U.S. Cl. ..... 428/609; 428/615; 428/679; 428/683; 428/685

[58] Field of Search ..... 428/609, 679, 683, 685, 428/615

[56] References Cited

U.S. PATENT DOCUMENTS

| | | | |
|---|---|---|---|
| 2,034,278 | 3/1936 | Becket et al. | 428/683 |
| 3,998,318 | 12/1976 | McAlarney | 428/609 |
| 4,064,608 | 12/1977 | Jaeger | 428/679 |
| 4,677,034 | 6/1987 | Luthra | 428/679 |

*Primary Examiner*—Wayland Stallard

*Attorney, Agent, or Firm*—Stevens, Davis, Miller & Mosher

[57] ABSTRACT

A machine part such as a cylinder or a feeding screw of an injection molding machine and the like is produced such that a separating metallic plate is inserted in a mold adapted to mold the cylinder or the feeding screw, thereby providing two molding cavities on both sides of the separating plate, and melted metals adapted to form a main portion and a corrosion and wear resistant portion of the cylinder or feeding screw are poured into the two cavities. In this manner the two kinds of metals poured into the two cavities are metallurgically fused together with the separating plate interposed therebetween.

9 Claims, 3 Drawing Sheets

PRODUCTION METHOD OF MACHINE PARTS AND THE MACHINE PARTS THUS PRODUCED

This is a Division of application Ser. No. 759,101 filed July 25, 1985, now U.S. Pat. No. 4,693,293.

BACKGROUND OF THE INVENTION

This invention relates to a production method of machine parts such as a cylinder and a feeding screw of an injection molding machine which is used for injection-molding or extrusion-molding a plastic or a ceramic material and also to the machine parts thus produced.

Recently, injection molding machines and extrusion molding machines which have been used for molding plastic materials have been further utilized for molding ceramic materials and the like, and the application field of the machines is thereby much expanded. However, a part of the machine such as a cylinder or a feeding screw which is generally made of cast iron and constantly and directly in contact with the aforementioned material is easily corroded and worn out by the material.

Various methods have been proposed for eliminating the difficulties and one of the most ordinary method is characterized by the formation of a nitride layer on the surface of the machine part. However, the nitride layer thus formed is excessively thin and easily worn out by the material to be used. According to another method, a member which is made of a corrosion-resistant material such as chromium cast iron, high-speed steel, tool steel, Hastelloy or the like is shrink-fitted, silver-brazed, or bonded by use of a bonding agent to an area of the machine part which is brought into contact with the plastic or ceramic material. In these cases, however, since the molding operation of the plastic or ceramic material is carried out at a temperature of 250° C. to 350° C. and heating and cooling operations are repeated, the shrinking stress of the shrinkage fit is adversely reduced. Moreover, in the case where the corrosionresistant member is bonded as described above, a bonded layer formed between the machine part and the corrosionresistant member tends to be cracked. Reduction of the shrinking stress or creation of cracks in the bonded layer reduces the heat transmission to the corrosion-resistant member, and hence the quality of the products of the injection molding machine and the like is made unsatisfactory. Furthermore, the wear and corrosion resistant member is in itself brittle, and therefore, the machine part shrink-fitted or bonded with this member becomes also brittle.

For obviating these difficulties, there is proposed a still further procedure wherein a self-fusing material or nickel or chromium series alloy is deposited in accordance with a metal spraying method or a centrifugal casting method for lining the portion of the machine part, that is, brought into direct contact with the plastic or ceramic material. Such a procedure, however, is hardly applicable to the machine part of a small diameter and a large length, and the lining technique based on the centrifugal casting method cannot be applied to a machine part other than a cylindrical configuration.

SUMMARY OF THE INVENTION

An object of the present invention is to provide a method for producing a machine part such as a cylinder or a feeding screw of an injection molding machine and the like, wherein the above described difficulties of the conventional methods can be substantially eliminated.

Another object of the invention is to provide a machine part as described above which is produced according to the aforementioned method.

According to the present invention, there is provided a method for producing a machine part to be used in a molding machine which is adapted to mold either one of plastic and ceramic materials into molded products, the method comprising the steps of preparing a mold provided with a mold cavity therein, inserting a separating metallic plate in the mold for separating the mold cavity into two portions adapted to form a main portion of the machine part and to form a corrosion and wear resistant portion of the same on both sides of the separating metallic plate, pouring a metal for forming the main portion and a corrosion and wear resistant metal for forming the corrosion and wear resisatant portion, both in melted state, into the mold cavities for producing the machine part in a manner that the two portions are metallurgically fused together with the separating metallic plate interposed therebetween.

According to another aspect of the present invention, there is provided a machine part to be used in a molding machine produced by the method described above comprising a main portion, a corrosion and wear resistant portion, and a separating metallic plate interposed between the two portions and metallurgically fused together therewith.

BRIEF DESCRIPTION OF THE DRAWINGS

In the accompanying drawings:

FIG. 5*b* is a side elevational view of the embodiment shown in FIG. 5*a.

DESCRIPTION OF THE PREFERRED EMBODIMENTS

This invention will now be described in detail with respect to a preferred embodiment for the production of a cylinder of an injection molding machine, for example, in conjunction with FIGS. 1 through 3.

Figure 1:
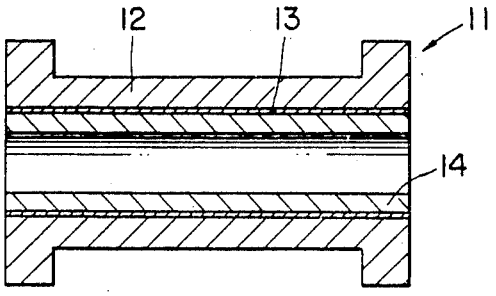
FIG. 1 is a longitudinal sectional view of a cylindrical member made in accordance with the method of this invention.
Figure 2:
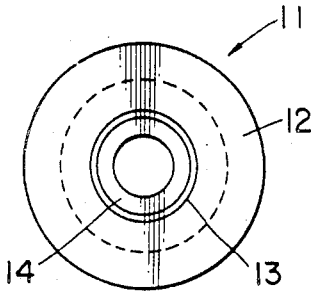
FIG. 2 is a side view of the cylinder shown in FIG. 1.
Figure 3:
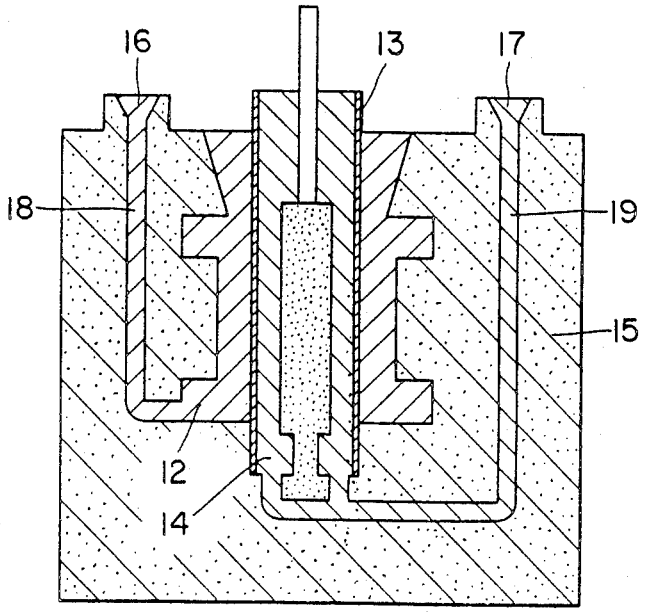
FIG. 3 is a sectional view adapted for explaining a production method of this invention.

Referring to FIGS. 1, 2 and 3, a cylinder 11 of the injection molding machine comprises a main body 12 of the cylinder 11, a partition or separating metal plate 13, and an internal portion 14 made of a corrosion and wear resistant metal, all combined into an integral member.

At the time of the production of the cylinder 11, the separating plate 13 made of a material selected from stainless steel, carbon steel, alloy steel cooper and its alloy and formed into a cylindrical configuration is firstly placed in a mold 15 so as to separate a mold cavity into an outer and inner portions. The internal and external surfaces of the separating plate 13 are plated or thermo-sprayed with a metal such as chromium, nickel, tin, copper or a copper alloy, or subjected to a surface treatment of either one of carburizing, nitriding and boriding.

A material such as a spheroidal graphite cast iron, gray cast iron, or cast steel, or copper or a copper alloy is poured in a melted state through a gate 16 into the outer molding cavity formed outside of the separating plate 13. On the other hand, a corrosion and wear resistant metal such as a chromium cast iron, stainless cast steel, tool steel, high-speed steel, and a nickel and cobalt alloy and an alloy obtained by adding either one or more of a carbide, nitride, and a boride thereto, is melted and poured through another gate 17 into the inner molding cavity formed inside of the separating plate 13. In order to prevent a deformation or damage of the separating plate 13, sprue runners 18 and 19 connected to the gate openings 16 and 17 and leading to the separated mold cavities are arranged, respectively, such that the levels of the melted metals rising up in the molding cavities are made equal to each other.

The above described plating or thermo-spraying of nickel, chromium or the like on the surfaces of the separating plate 13 is carried out for realizing a metallurgical fusion between the separating plate 13 and the melted metals poured on both sides thereof. For this purpose, the metal thus plated or heat sprayed may be of a low melting point such as tin or copper or a copper alloy.

Practical examples of the production of the cylinder will now be described hereinbelow.

EXAMPLE 1

A separating plate made of a carbon steel and formed into a cylindrical configuration was plated with nickel of 10 microns in thickness and placed in a mold, as shown in FIG. 3, which has been preheated to 200° C.

A cast steel consisting of C (0.1–0.3%), Si (0.1–1.0%), Mn (0.1–1.5%) and balance essentially iron, and a corrosion and wear resistant chromium cast iron consisting of C (2.0–4.0p%), Si (0.3–2.0%), Mn (0.2–1.5%), Cr (20–30%), and balance being essentially iron were melted in separate high-frequency furnaces at about 1680° C. and 1580° C., respectively. The cast steel and the corrosion and wear resistant chromium cast iron were poured through the gates 16 and 17 and the runners 18 and 19 of the mold shown in FIG. 3 into the outer and inner molding cavities separated by the separating plate, respectively, so that the liquid surfaces of the melted metals on both sides of the separating plate in the mold were held at the same level. In this manner, the deformation or displacement of the separating plate 13 could be prevented and the desired measurements of the produced cylinder could be assured. Furthermore, it was found that the boundary portions between the separating plate 13 and the outer and inner metals were in a completely fused state, and that the breaking strengths of the fused portions were more than 30 kg/mm$^2$ substantially being equal to that of the chromium cast iron.

EXAMPLE 2

Figure 4:
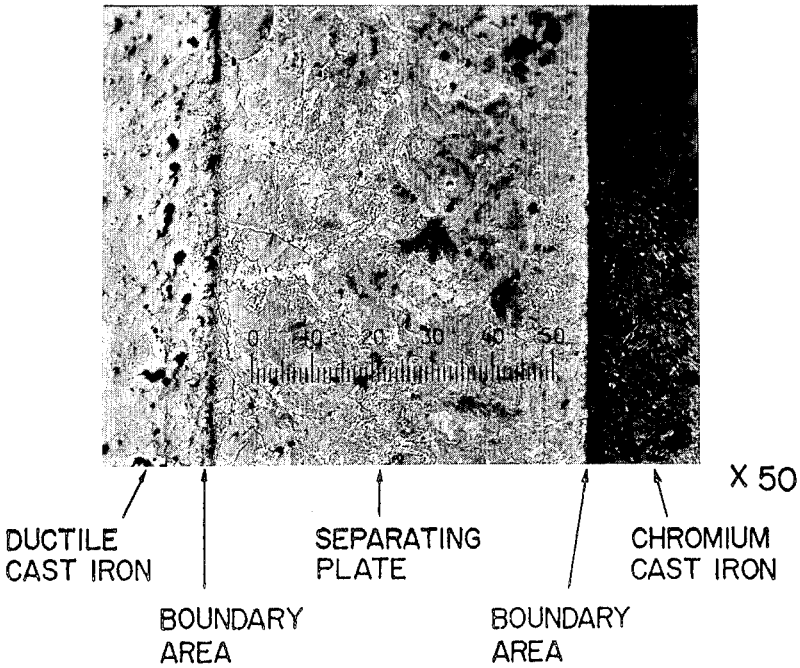
FIG. 4 is a microscopic photograph showing a boundary portion formed between two different metals used in this invention.
Figure 5A:
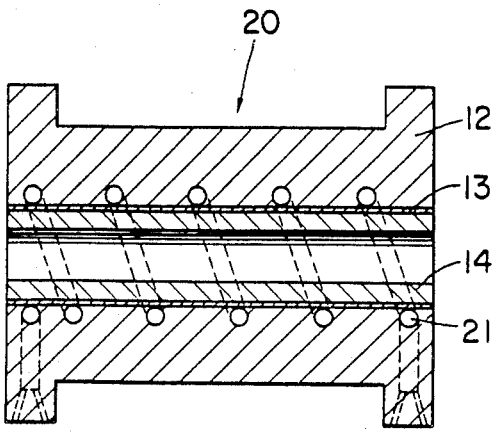
FIG. 5*a* is a longitudinal sectional view of a cylinder having two internal bores and a cooling pipe and constituting another embodiment according to this invention.
Figure 5B:
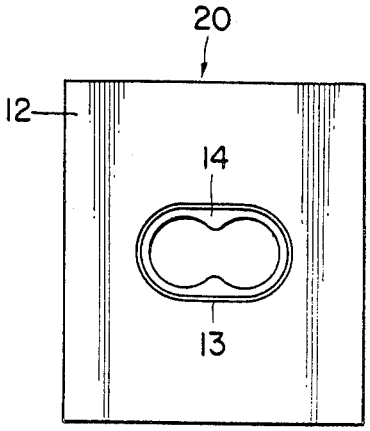

A separating plate 13 made of a carbon steel and formed into a cylindrical configuration which is adapted to be used for the production of a cylinder 20 having two internal bores as shown in FIGS. 5*a* and 5*b* was welded with a helical pipe 21 of heating or cooling use, made of a metal selected from a carbon steel, stainless steel and copper, and then subjected to nickel plating. The separating plate 13 thus welded and plated was inserted in a mold shown in FIG. 3 as in the case of the previous example. A ductile cast iron consisting of C (3.0–4.0%), Si (1.5–3%), and Mn (0.2–1.0%) and a corrosion and wear resistant chromium cast iron consisting of C (2.0–4.0%), Si (0.3–1.0%), Mn (0.2–1.5%) and Cr (20–30%), which were melted at about 1430° C. and 1500° C., respectively, were poured through the gates 16 and 17 into the outer and inner molding cavities formed outside and inside of the separating plate 13, respectively, as in the case of the previous example. FIG. 4 is a photograph showing a microscopic structure obtained at a portion of the thus produced cylinder where the separating plate is fused with the ductile cast iron and the chromium cast iron solidified on both sides of the separating plate 13. According to the method of the example 2, a cylinder having a cooling or heating pipe and operable satisfactorily could be produced in a simple manner and at a low cost.

It is of course understood by those skilled in the art that, in the above-mentioned examples, the contents (percentages) of the main body and the corrosion and wear resistant material layer, and the treating temperature are numerically disclosed, but they are not limited to the numerical values disclosed and any other modifications can be considered.

Figure 6:
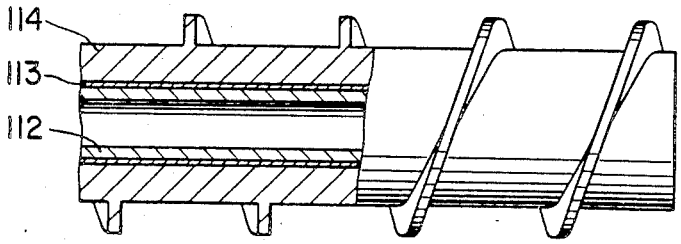
* and FIG. 6 is a longitudinal sectional view of a part of a screw member made in accordance with the method of this invention.

Furthermore, also in the foregoings, although a heating cylinder is referred to as a machine part of an injection molding machine and the like, substantially the same method or procedure can be applied to a feeding screw member for the molding machine. FIG 6 shows a part of one example of the thus produced screw member, which comprises a main body 112, a separating plate 113, and a corrosion and wear resistant material layer 114, and in our experiment, such screw memeber could be preferably produced by substantially the same method as described with reference to the heating cylinder in conjunction with FIGS. 1 through 3.

According to this invention, a corrosion and wear resistant metal which is in itself brittle can be used effectively and functionally, and in the boundary areas between the two metals and the separating plate, homogeneous metallurgical fusions can be obtained. As a consequence, the heat conductivity between the two metals is far improved in comparison with that of the conventional construction, and the quality of the products can be improved. Furthermore, the restriction about the shape of the internal bore of the cylinder can be widely reduced, inclusion of a cooling or heating pipe is allowed within the cylinder, and the amount of machining required for the production of the cylinder can be substantially reduced.

What is claimed is:

1. A cylinder for a molding machine comprising a metal main portion, a corrosion and wear-resistant metal inner portion, and a separating metal plate interposed between and metallurgically fused to the metal main portion and to the metal internal portion of the cylinder.

2. A feed screw for a molding machine comprising a metal main portion, a corrosion and wear-resistant outer portion, and a separating metal plate interposed between and metallurgically fused to the metal main portion and to the outer metal portion of the screw.

3. A machine cylinder according to claim 1, which further comprises an helical-shaped pipe for heating or cooling use, which is secured to said separating metallic plate before it is inserted in said molding machine.

4. A cylinder according to claim 1 wherein said corrosion and wear resistant metal is a material selected from a group consisting of a chromium cast iron, nickel alloy, and a cobalt alloy.

5. A cylinder according to claim 1 wherein said metal for producing said main portion is a material selected from a group consisting of a spheroidal graphite cast iron, gray cast iron, cast steel and a copper alloy.

6. A cylinder according to claim 1 wherein said separating metallic plate is made of a material selected from a group consisting of a stainless steel, carbon steel, and alloy steel.

7. A cylinder according to claim 6 wherein said separating metallic plate is further subjected to either one or chromium, nickel, and copper plating, and thermospraying of either one of a nickel alloy and a cobalt alloy.

8. A cylinder as set forth in claim 6 wherein said separating metallic plate is subjected to a surface treatment of either one of carburizing and nitriding.

9. The machine part according to claim 3 wherein the helical-shaped pipe is made of a metal selected from a carbon steel, stainless steel, and copper.

* * * * *